US011369975B2

(12) United States Patent
Hepperle et al.

(10) Patent No.: US 11,369,975 B2
(45) Date of Patent: Jun. 28, 2022

(54) FILTER UNIT FOR AN EXTRACTOR HOOD, AND EXTRACTOR HOOD

(71) Applicant: BSH Hausgeräte GmbH, Munich (DE)

(72) Inventors: Georg Hepperle, Heilbronn (DE); Daniel Vollmar, Pfinztal (DE); Jens Herbst, Bretten (DE); Holger Eich, Rheinstetten (DE)

(73) Assignee: BSH Hausgeräte GmbH, Munich (DE)

( * ) Notice: Subject to any disclaimer, the term of this patent is extended or adjusted under 35 U.S.C. 154(b) by 414 days.

(21) Appl. No.: 16/488,950

(22) PCT Filed: Feb. 21, 2018

(86) PCT No.: PCT/EP2018/054213
§ 371 (c)(1),
(2) Date: Aug. 27, 2019

(87) PCT Pub. No.: WO2018/166764
PCT Pub. Date: Sep. 20, 2018

(65) Prior Publication Data

US 2020/0009577 A1 Jan. 9, 2020

(30) Foreign Application Priority Data

Mar. 13, 2017 (DE) ..... 10 2017 204 059.9

(51) Int. Cl.
*B03C 3/08* (2006.01)
*B03C 3/12* (2006.01)
(Continued)

(52) U.S. Cl.
CPC ..... *B03C 3/08* (2013.01); *B03C 3/12* (2013.01); *B03C 3/47* (2013.01); *B03C 3/82* (2013.01);
(Continued)

(58) Field of Classification Search
CPC combination set(s) only.
See application file for complete search history.

(56) References Cited

U.S. PATENT DOCUMENTS 3,785,124 A * 1/1974 Gaylord ..... F24C 15/2057 96/19
5,669,963 A * 9/1997 Horton ..... B03C 3/12 96/77
(Continued)

FOREIGN PATENT DOCUMENTS

CN 1654128 A 8/2005
CN 102188871 A 9/2011
(Continued)

OTHER PUBLICATIONS

National Search Report CN 201880018111.1 dated Apr. 28, 2020.
International Search Report PCT/EP2018/054213 dated May 18, 2018.

*Primary Examiner* — Christopher P Jones
*Assistant Examiner* — Sonji Turner
(74) *Attorney, Agent, or Firm* — Michael E. Tschupp; Andre Pallapies; Brandon G. Braun

(57) ABSTRACT

A filter unit for an extractor hood includes a housing and an electric contact element arranged on a wall of the housing such as to be accessible from outside. Accommodated in the housing are an ionization unit and a separation unit which is mounted in the housing downstream of the ionization unit in a direction of flow.

20 Claims, 3 Drawing Sheets

(51) Int. Cl.

| | |
|---|---|
| ***B03C 3/47*** | (2006.01) |
| *B03C 3/82* | (2006.01) |
| *F24C 15/20* | (2006.01) |

(52) U.S. Cl.
CPC ..... *B03C 2201/28* (2013.01); *F24C 15/2035* (2013.01)

(56) References Cited

U.S. PATENT DOCUMENTS

| | | | | |
|---|---|---|---|---|
| 2010/0089240 | A1* | 4/2010 | Krichtafovitch | B03C 3/368 96/32 |
| 2010/0163012 | A1* | 7/2010 | Adar | F24C 15/20 126/299 D |

FOREIGN PATENT DOCUMENTS

| | | | | |
|---|---|---|---|---|
| CN | 202452551 | U | 9/2012 | |
| CN | 103623664 | A | 3/2014 | |
| CN | 204710015 | U | 10/2015 | |
| DE | 4207022 | A1 * | 9/1993 | F24C 15/2035 |
| EP | 0559038 | A2 | 9/1993 | |
| JP | 58030353 | A * | 2/1983 | |

* cited by examiner

FILTER UNIT FOR AN EXTRACTOR HOOD, AND EXTRACTOR HOOD

CROSS-REFERENCES TO RELATED APPLICATIONS

This application is the U.S. National Stage of International Application No. PCT/EP2018/054213, filed Feb. 21, 2018, which designated the United States and has been published as International Publication No. WO 2018/166764 A1 and which claims the priority of German Patent Application, Serial No. 10 2017 204 059.9, filed Mar. 13, 2017 pursuant to 35 U.S.C. 119(a)-(d).

BACKGROUND OF THE INVENTION

The invention relates to a filter unit for an extractor hood, in particular an extractor hood unit, and an extractor hood comprising at least one filter unit.

In extractor hoods, in particular extractor hood units which are operated in a kitchen, it is known to filter out liquid and solid contaminants as well as odors from the fumes and steam produced during cooking. To this end, mechanical filters are generally inserted in the extractor hood. For example, expanded metal filters, perforated metal filters, baffle filters, which may also be denoted as eddy current filters, edge suction filters and porous foam media, are used as mechanical filters.

Additionally, an extractor hood unit is disclosed, for example, in DE 2146288 A in which an electrostatic filter unit is used. The electrostatic filter unit in this extractor hood unit consists of plate-shaped separator and counter electrodes and wire-shaped ionization electrodes. The plate-shaped separator and counter electrodes are connected together via electrically conductive webs and are arranged such that air entering the filter element initially flows onto the separator electrodes with the wire-shaped ionization elements located therebetween and subsequently reaches the counter electrodes which are offset upwardly. The separator electrodes are fastened via a partition to the housing of the extractor hood unit. Additionally, a high voltage device which is connected to the electrodes of the electrodes of the filter unit is provided in the housing of the extractor hood unit.

A drawback of this filter unit is that the construction thereof is complex. Additionally, due to its construction the filter unit is not able to be removed from the extractor hood unit.

BRIEF SUMMARY OF THE INVENTION

It is, therefore, the object of the present invention to provide a filter unit for an extractor hood and an extractor hood which have a simple construction, are simple to handle and yet permit a reliable cleaning of fumes and steam and other contaminated air.

The invention is based on the recognition that this object may be achieved by a filter unit being provided which makes use of the electrostatic filter principle but which may be introduced into an extractor hood and removed therefrom in a simple manner.

According to a first feature, the object is achieved by a filter unit for an extractor hood, comprising an ionization unit and a separation unit. The filter unit is characterized in that the separation unit is mounted downstream of the ionization unit in the direction of flow, and the ionization unit and the separation unit are accommodated in a common housing, on at least one wall of which an electric contact element is arranged that is accessible from the outside.

The filter unit is also denoted as a filter module. The filter unit represents a portable filter unit which is able to be removed from the extractor hood and which is preferably preassembled. A filter unit which may be inserted as a structural unit into the extractor hood and may be removed therefrom in one unit is denoted as preassembled. An extractor hood device which, for example, may be an extractor hood unit or a ceiling fan is denoted as an extractor hood. Preferably, the extractor hood has a suction slot. The suction slot may be formed, for example, between an extractor hood housing and an impact plate which is arranged offset thereto below the extractor hood housing. The suction slot may also be denoted as an edge suction slot.

The filter unit comprises an ionization unit which may also be denoted as an ionization stage and a separation unit which may also be denoted as a separation stage. The ionization stage preferably has at least one ionization element and at least one counter electrode. The separation stage has at least one collection electrode and at least one counter electrode. The separation stage is arranged downstream of the filter unit of the ionization stage in the direction of flow. The ionization element is subjected to voltage, preferably high voltage. When contaminated air flows through the ionization stage, solid and liquid substances are electrostatically charged by means of the ionization element which may also be denoted as an emission electrode. The separation stage preferably comprises at least one collection electrode and at least one counter electrode which are designed to be plate-shaped and arranged alternately in the separation stage.

According to the invention, the filter unit comprises a housing. The housing preferably consists of electrically non-conductive material. Both the ionization unit and the separation unit are accommodated in the housing. The housing thus represents a common housing for these two units. Since the filter unit has such a housing, this filter unit may be introduced in a simple manner into the extractor hood or removed therefrom as a unit.

The housing has, in particular, a box shape. In this case, the bottom and the top wall of the housing and two side walls are formed by air-impermeable plates. The front face and the rear face of the housing, however, are formed so as to be open or by an air-permeable component, in particular a grille.

Directional information such as above, below, front and rear refer, unless specified otherwise, to a filter unit in a state in which it is introduced into a vertical suction slot of an extractor hood. In this case the side oriented outwardly is understood as the front face, via which air may enter the filter unit. The rear face faces the interior of the extractor hood. In the case of a filter unit introduced in this manner into a vertical suction slot of an extractor hood, the direction of flow in which air flows through the filter unit is located in the horizontal.

According to the invention, the housing of the filter unit has on at least one wall an electric contact element which is accessible from the outside. A contact element which may be connected to a voltage source without opening the housing of the filter unit and via which current and voltage may be conducted to the electrodes located in the housing, is denoted as an electric contact element which is accessible from the outside.

Since the filter unit according to the invention has a common housing for the separation unit and the ionization unit and at least one electric contact element which is accessible from the outside is also provided on the housing, the filter unit may be introduced as one component into an extractor hood, for example pushed in and removed therefrom again. In this case it is ensured that the voltage may be applied to the electrodes of the separation unit and ionization unit by means of the contact elements. Thus the filter unit may be used in a simple manner as a module of a filter system which may consist of a plurality of filter units.

According to a preferred embodiment, the housing has a top wall, a bottom wall and at least three side walls and one of the side walls is at least partially formed by a protective grille. The bottom wall represents the lower face of the filter unit and the top wall represents the upper face of the filter unit. In this case in the state of the filter unit introduced into the extractor hood, the bottom and the top wall are preferably located in the horizontal. As a result, contaminants separated in the filter unit may be prevented from escaping. The side of the housing of the filter unit which is formed at least partially by a protective grille, preferably represents the front face of the filter unit. In the state of the filter unit introduced into the extractor hood, the front face of the filter unit is the side of the filter unit which faces outwardly and via which air may enter the filter unit. The side wall which forms the front face of the filter unit may be formed entirely by a protective grille. Since the housing on this side is formed by a side wall which consists at least partially of a grille, firstly the entry of air may be ensured and secondly, however, the access of the user of the filter unit and the extractor hood to the internal electrodes of the filter unit may be prevented. Additionally, by the provision of a protective grille the stability of the housing is increased relative to a housing which is open toward the front and, as a result, the handlability of the filter unit improved. In particular, the housing is not at risk of deformation when removed from the extractor hood and when cleaned outside the extractor hood.

According to a preferred embodiment, a drainage channel is configured on the housing. The drainage channel is preferably formed on the rear face of the housing, i.e. on the side which opposes the side wall which is formed by the protective grille. Particularly preferably, the drainage channel is formed by an extension of the bottom wall to the rear. The drainage channel may have an incline which extends downwardly inclined out of the rear face of the bottom wall of the housing of the filter unit. By the provision of a drainage channel, contaminants which have been separated in the filter unit may be collected. Thus by the provision of a drainage channel the service time, i.e. the interval between the required cleaning of the filter unit, is extended. Since the drainage channel is preferably provided on the rear face of the housing and in the introduced state the rear face faces the interior of the extractor hood, this drainage channel is not visible during the use of the extractor hood and contaminants from the drainage channel may be prevented from dripping out of the extractor fan.

According to one embodiment, collection electrodes and counter electrodes are arranged alternately in the separation unit and the collection electrodes and counter electrodes represent plates which extend parallel to the bottom of the housing of the filter unit. In this embodiment, the plates, i.e. the collection electrodes and counter electrodes, are arranged alternately. The electrodes are thus electrically charged alternately. The positive collection electrodes are subjected to positive electrical high voltage. During the operation of the filter an electrical field is formed between the alternately arranged positive collection electrodes and negative counter electrodes. The effect of this electrical field is that the solid and liquid substances which have already been charged in the ionization unit are deflected from the airflow by the electrical field and deposited and/or separated on the collection electrodes and counter electrodes. These solid and liquid substances are deposited in the form of contaminants on the collection electrodes and counter electrodes of the separation unit. In the embodiment in which the collection electrodes and counter electrodes are arranged parallel to the bottom of the housing of the filter unit in the separation unit, the separation unit has a simplified construction. The filter unit preferably has a greater width than height. As a result, the filter unit may be introduced in a simple manner into an extractor hood and, in particular, into a vertically extending suction slot. In the embodiment in which the electrodes in the separation unit are arranged parallel to the bottom of the housing of the filter unit, therefore, a small number of electrodes is sufficient in order to permit a separation over the entire height and width of the filter unit.

However, according to a further embodiment it is provided that collection electrodes and counter electrodes are arranged alternately in the separation unit and the collection electrodes and counter electrodes represent plates which extend perpendicular to the bottom of the housing of the filter unit. In this embodiment, the number of electrodes which have to be provided in the separation unit is greater than in the embodiment with electrodes arranged parallel to the bottom. However, with electrodes arranged perpendicular to the bottom of the housing, contaminants which have been deposited on the plates pass down along said plates and optionally collect in a drainage channel provided on the housing.

According to a preferred embodiment, the collection electrodes and counter electrodes which are formed by plates and which are located perpendicular to the bottom of the housing, are combined in each case to form a comb profile and the comb profiles interlock. In this embodiment, the construction of the filter unit is further simplified since only two components are required, namely a comb profile with collection electrodes and a comb profile with counter electrodes. In this embodiment the plate-shaped electrodes may also be denoted as ribs. The comb profiles may be fastened to the housing in a simple manner. By the comb base, which connects together the plates of the respective comb profile, the stability of the filter unit is additionally improved as a whole. By the interlocking of the comb profiles the collection electrodes and counter electrodes are present alternately.

According to a preferred embodiment, an ionization element which extends parallel to the bottom of the housing is arranged in the ionization unit. Particularly preferably, just one ionization element is arranged in the ionization unit. As a result, the construction of the filter unit is further simplified. In particular, the ionization element may extend over the entire width of the housing of the filter unit and, therefore, only has to be fastened at the longitudinal ends. In particular, in the embodiment in which the plate-shaped electrodes of the separation unit are perpendicular to the bottom of the housing, with an ionization element extending perpendicular thereto it is ensured that the air which enters between the plate-shaped electrodes has been previously reliably ionized in the ionization unit, i.e. the contaminants in the air have been ionized.

According to a further feature, the present invention relates to an extractor hood which has an extractor hood housing with at least one suction slot. The extractor hood is characterized in that at least one filter unit according to the invention is releasably arranged in the suction slot.

Advantages and features which have been described and will be described relative to the filter unit according to the invention also apply—if applicable—to the extractor hood according to the invention and vice-versa.

Since filter units according to the invention are provided so as to be releasable in the extractor hood, the modular construction of the filter system of the extractor hood may be implemented in a simple manner. Thus the filter units may be removed individually from the extractor hood, for example for cleaning purposes. The filter units are arranged in a suction slot. The opening of the extractor hood via which air is suctioned into the extractor hood is denoted as the suction slot. To this end, a fan which may also be denoted as a blower is arranged in the extractor hood housing.

According to a preferred embodiment, at least two filter units are arranged adjacent to one another in the suction slot. As a result, the size, i.e. in particular the width, of the individual filter elements may be kept small and therefore said filter elements may be handled in a simple manner. For example, the weight of a smaller-sized filter unit is lower and a removal of the filter unit from the suction slot may, therefore, take place without a large expenditure of force. Preferably, so many filter units are arranged adjacent to one another in the suction slot that all of the air which is able to be suctioned via the suction slot into the extractor hood is conducted via the filter units. Since the filter units in each case have a housing and this housing is formed on the side walls by air-impermeable walls, filter units may also be arranged across the corners, i.e. adjacent to one another such that the respective rearward end of a side wall of two filter units bear against one another.

According to a preferred embodiment, the suction slot extends over at least a part of the periphery of the extractor hood housing and is preferably oriented vertically. In this embodiment, the filter units according to the invention may be inserted in a particularly simple manner from the sides into the suction slot. Additionally, with a vertical orientation of the suction slot and thus a horizontal orientation of the filter unit, contaminants are prevented from draining out of the filter unit.

According to one embodiment, the suction slot is defined downwardly by an impact plate and the at least one filter unit is fastened to the impact plate. In this embodiment, the upper edge of the suction slot is formed by the lower face of the extractor hood housing in which an inlet opening for air is provided. The impact plate may be fixedly connected to the extractor hood housing or fastened thereto so as to be extendable downwardly.

The filter units may also be connected by means of mechanical connection elements to the extractor hood, in addition to a connection by means of the electric contact elements. In this case, the filter units, for example, may have latching devices which cooperate with further latching devices on the extractor hood and the filter units are thus fastened to the extractor hood.

According to a preferred embodiment, at least in the region of the outwardly facing side of the filter unit a screen is fastened to the filter unit or the extractor hood. The outwardly facing side of the filter unit is also denoted as the front face of the filter unit. Via this side, air may enter the filter unit. In this side, the filter unit is preferably formed at least partially by a protective grille. By the provision of a screen, firstly further protection may be ensured against access to the interior of the filter units. Secondly, by means of the screen the air may also be conducted specifically to the front face of the filter units and thus assist with the reliable cleaning of the air. The screen is preferably provided along the entire length of the suction slot. At least the screen(s) cover(s) at least the front faces of the filter units. The screen(s) may be fastened to the filter unit(s). Additionally or alternatively, the screens may also be fastened to the extractor hood, for example to the extractor hood housing and/or an optionally provided impact plate.

The screen may be formed by a grille screen or by curved air guidance elements. In the case of the curved air guidance elements, these are preferably oriented such that said air guidance elements deflect air which flows onto the extractor hood from below to the suction slot. In a vertically extending suction slot, therefore, the air is deflected on the air guidance elements by 90°. The air guidance elements may also be denoted as air guidance blades.

BRIEF DESCRIPTION OF THE DRAWINGS

The invention is described hereinafter with further reference to the accompanying drawings, in which.

DETAILED DESCRIPTION OF EXEMPLARY EMBODIMENTS OF THE PRESENT INVENTION

Figure 1:
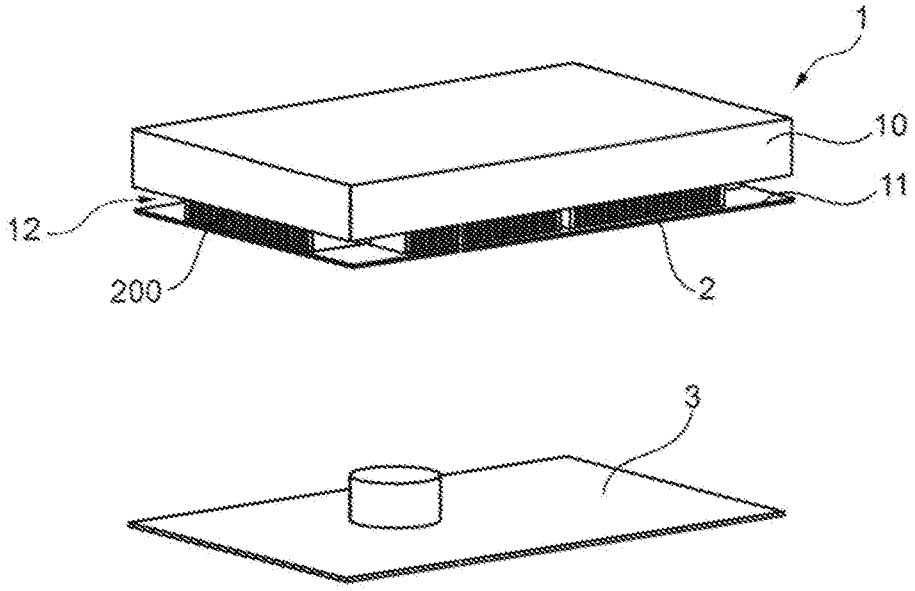
FIG. 1: shows a schematic perspective view of an embodiment of an extractor hood according to the invention.

In FIG. 1 an embodiment of an extractor hood 1 according to the invention, which may also be denoted as an extractor hood device or extractor hood unit, is shown. The extractor hood 1 has in the embodiment shown an extractor hood housing 10 and an impact plate 11 located below, i.e. in the direction of flow upstream of the lower face of the extractor hood housing 10. In this case a suction slot 12, which may also be denoted as a suction gap, is formed between the lower face of the extractor hood housing 10 and the impact plate 11. A plurality of filter units 2 are introduced into the suction slot 12. In the view shown, over the width of the extractor hood 1 two filter units are introduced and over the depth of the extractor hood 1 one filter unit 2 is introduced. The extractor hood 1 is attached above a stove 3 and may, for example, be accommodated in the ceiling (not shown), wherein at least the suction slot 12 is located at least occasionally below the ceiling. In FIG. 1 only the protective grilles 200 which form the front faces of the filter units 2 are shown of the filter units 2.

In FIG. 1 the electrostatic filter system of modular construction according to the invention is shown in which the individual filter units 2, which are also denoted as filter modules 2, are arranged directly in the suction slot, which may also be denoted as the suction gap, between the extractor hood housing 10 and the impact plate 11 located upstream thereof. The filter modules 2 may be used here in any number depending on the size of the extractor hood. The orientation, spacing, arrangement and position of the extractor hood or a similar suctioning device 1 relative to the stove 3 is optional and accordingly may be arranged at any angle and spacing from the stove 3.

The air flows in the suction slot through the individual electrostatic filter modules 2. It is important here that the air flows through the individual electrostatic filter modules 2. No air, i.e. no steam, is permitted to flow through the spacing between adjacent filter units 2, since in this case the air would then pass unfiltered through the extractor hood 1. In order to prevent this, openings, holes or gaps between the respective electrostatic filter units are structurally blocked.

Figure 2:
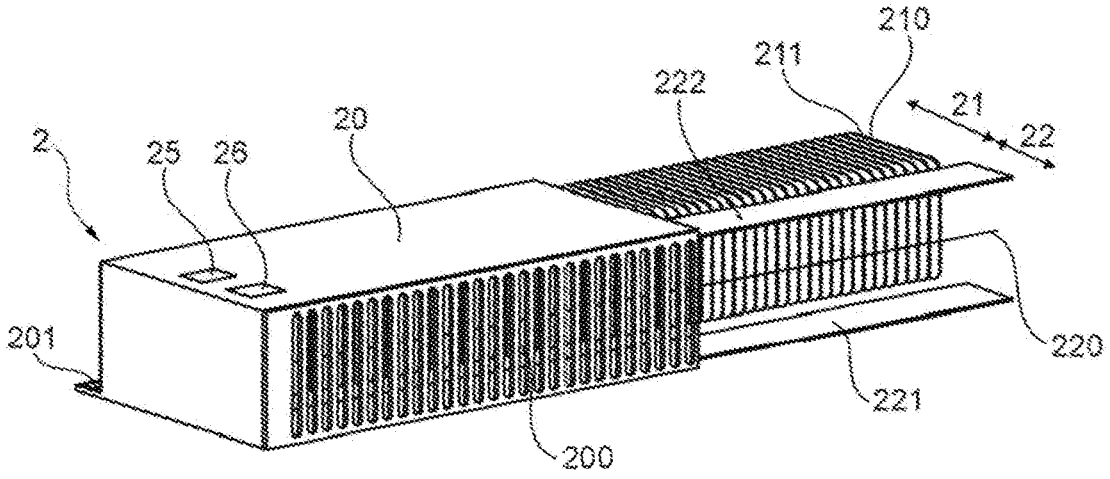
FIG. 2: shows a schematic perspective view of an embodiment of a filter unit according to the invention.
Figure 3:
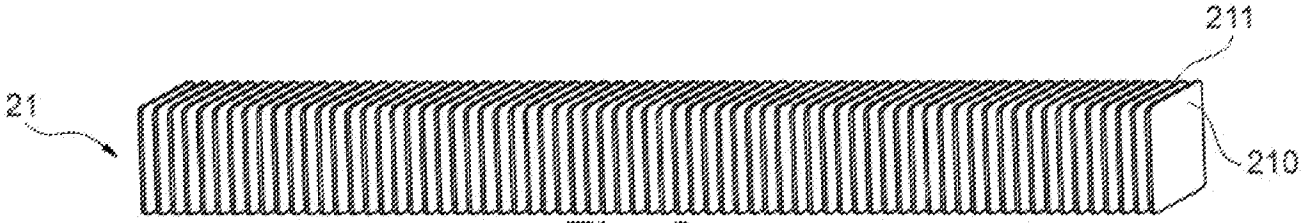
FIG. 3: shows a schematic perspective view of the electrodes of the separation unit of an embodiment of the filter unit according to the invention.

A schematic perspective view of an embodiment of a filter unit 2 according to the invention, which may also be denoted as a filter cassette or filter module, is illustrated in FIG. 2. The electrostatic filter unit 2 consists of an ionization unit 22 mounted upstream and a separation unit 21 mounted downstream in the direction of flow. In the ionization unit 22, which may also be denoted as ionization region or ionization stage, an ionization element 220 is arranged centrally between two negative and/or earthed counter electrodes 221, 222. The ionization element 220, which may also be denoted as an emission electrode, is subjected to positive electrical high voltage, for example <6 kV (<6000V).

The ionization element 220 in the embodiment shown is located parallel to the bottom of the housing 20 of the filter unit 2 and extends over the entire width of the housing 20. The ionization element 220 is arranged halfway up on the housing 20. The counter electrodes 221, 222 are arranged on the lower face of the top wall of the housing 20 and/or on the upper face of the bottom of the housing 220. The counter electrodes 221, 222 and the ionization element 220 are located in the front region of the housing 20 downstream of the protective grille 200 forming the front face of the housing 20.

Thin wires with a wire diameter of for example <0.1 mm may be considered as the ionization element 220. Alternatively, a saw-tooth ionization element (not shown) may also be used as the ionization element 220.

In the ionization unit 22 the solid and liquid particles in the airflow are electrostatically charged and separated in the separation unit 21 mounted downstream.

The separation unit 21 consists of plates, so-called collection electrodes 211 and counter electrodes 210. The plates are arranged parallel to one another and in the embodiment shown in FIG. 2 are located in the vertical, i.e. oriented perpendicular to the bottom of the housing 20.

Figure 4:
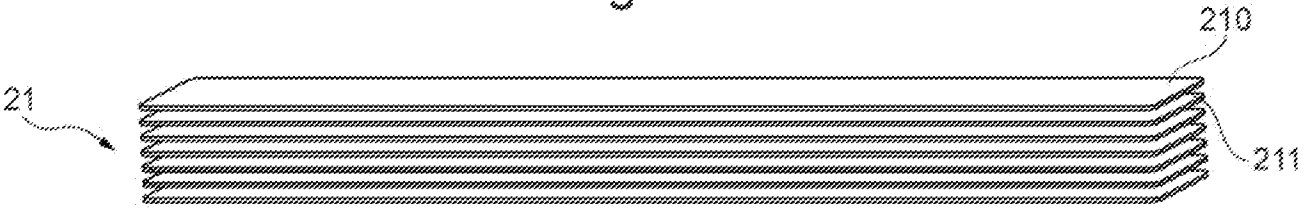
FIG. 4: shows a schematic perspective view of the electrodes of the separation unit of a further embodiment of the filter unit according to the invention.

As is revealed from FIG. 4, however, the electrodes 211, 210 may also be located in the horizontal, i.e. oriented parallel to the bottom of the housing 20.

The plates (collection electrodes 211 and counter electrodes 210) in this case are arranged alternately. Thus electrically charged electrodes 211, 210 are present alternately in the separation unit 21. The positive electrodes 211 are subjected to positive electrical high voltage. During the operation of the filter an electrical field is formed between the alternately arranged positive and negative electrodes 211, 210. The effect of this electrical field is that the solid and liquid substances from the airflow, which have already been charged in the ionization unit 22, are deflected from the airflow by the electrical field and are deposited and/or separated on the collection electrodes 211 and/or counter electrodes 210. These solid and liquid substances are deposited in the form of contaminants on the collection electrodes 211 and/or counter electrodes 210.

Figure 5A:
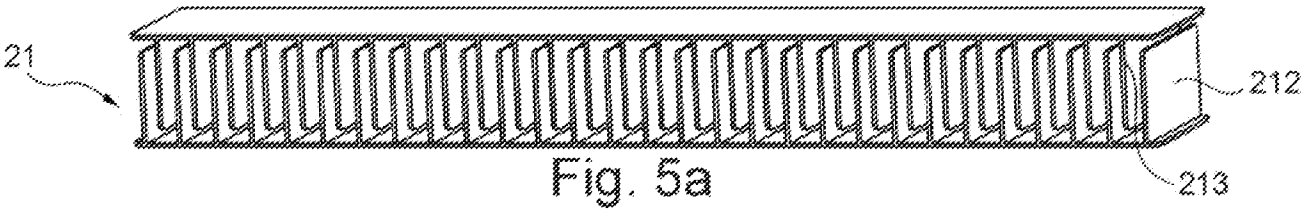
FIGS. 5*a* and 5*b*: show schematic views of the electrodes of the separation unit of a further embodiment of the filter unit according to the invention.
Figure 5B:
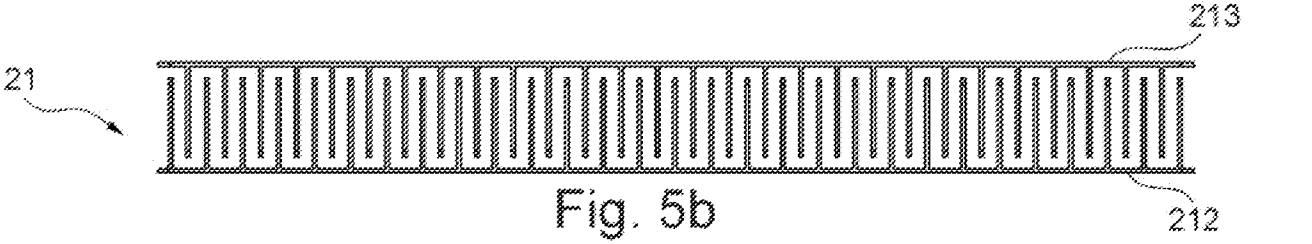

In FIGS. 5*a* and 5*b* a further very effective solution for the separation unit 21 is shown. In this case, the separation unit 21 consists of two interlocking comb profiles 212, 213 which may also be denoted as web profiles or rib profiles which are connected together and/or are held at a spacing from one another only at the lateral fastening points by an insulating material. In this case, the individual ribs of the respective comb profiles 212, 213 are not in contact. If the positive collection electrode 213 is applied onto positive electrical voltage and the negative counter electrode 212 is applied onto a negative and/or earthed potential, an electrical field is formed between both comb profiles 212, 213.

Both the ionization unit 22 and the separation unit 21 are accommodated according to FIG. 2 in an electrically insulating housing 20. The housing 20 contains a hand guard in the form of a protective grille 200. The protective grille 200 is intended to prevent contact with the individual ionization and separation parts which are in position. The housing 20 may consist both of a single part including the protective grille 200 or a plurality of individual parts (not shown). Moreover, in the embodiment shown in FIG. 2, a drainage channel 201 and/or a reservoir is in position in the housing 20. The purpose of this drainage channel 201 is so that the contaminants separated on the collection electrodes 211 and counter electrodes 210 in the form of solid and liquid substances drain away along the plates and collect in the drainage channel 201 and on the housing bottom.

The individual electrostatic filter units 2 may be removed from the extractor hood 1 and subsequently cleaned in the dishwasher or a similar cleaning device.

For the supply of electrical current and voltage, electric contact elements 25, 26 which ensure the electrical contact between the extractor hood 1 and the electrostatic filter module 2 are located on the housing 20. In FIG. 2, the contact elements 25, 26 are located on the top wall, i.e. provided on the upper face of the housing 20. The electrical contact, however, may also be implemented on different housing surfaces of an individual electrical filter module 2, for example also on the bottom and thus between the filter unit 2 and the impact plate 11 shown in FIG. 1.

Figure 6:
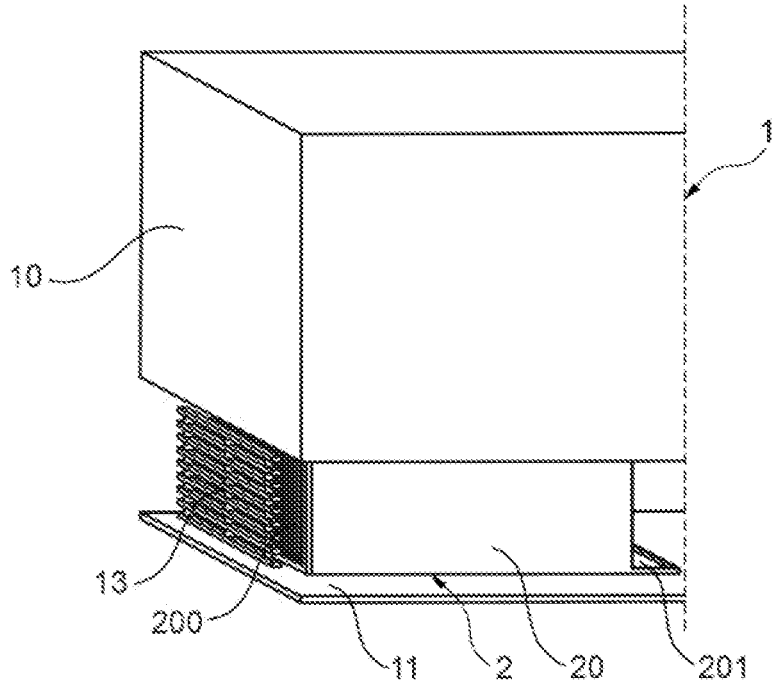
FIG. 6: shows a schematic perspective view of a part of an embodiment of the extractor hood according to the invention.

In FIG. 6 a part of the extractor hood 1 according to an embodiment of the invention is shown. In this embodiment, a screen in the form of a screen grille 13 is provided over the entire gap periphery and/or the gap length of the suction slot 12 upstream of the electrostatic filter units 2. This screen grille 13 serves as an additional hand guard to the protective grille 200 already provided on the housing 20. Thus the screen serves as an additional measure against contact with the electrostatic components. Additionally, an aerodynamic orientation of the airflow to the filter unit 2 may be achieved by means of the grille. The geometry and/or structure of this screen, in particular the screen grille 13, is made according to legal standards and technical design features. A VDE (Verband der Elektrotechnik—Association of German Electrical Engineers) test probe should not pass through.

Figure 7:
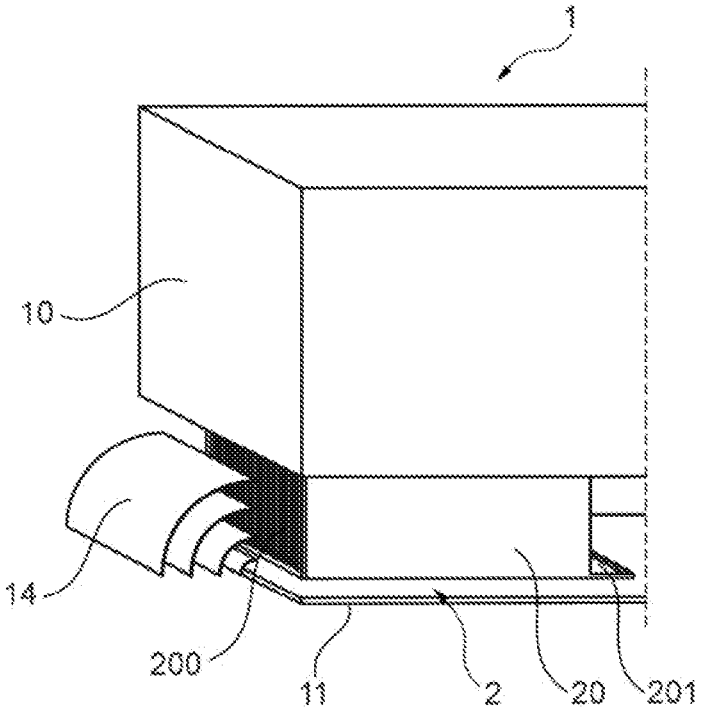
FIG. 7: shows a schematic perspective view of a part of a further embodiment of the extractor hood according to the invention.

In FIG. 7 as an alternative to the screen grille 13 a guide geometry which is formed by air guidance elements 14 is used. This guide geometry primarily ensures a uniform flow of air to the filter unit 2 in the suction slot 12 and additionally serves as a hand guard for safety-technical reasons. With regard to a uniform flow of air the requirement of these air guidance elements 14 is to transfer steam, which is produced during a cooking process, from the vertical flow direction into the horizontal flow direction. By this measure it is ensured that the steam and other contaminants are uniformly suctioned via the entire inlet cross section, in particular an optionally provided protective grille 200 of the respective electrostatic filter units 2. The air guidance elements 14 in the embodiment shown in FIG. 7 are formed by individual blades which do not have a gradient and are optimally circular arc-shaped. The entry angle and exit angle of the guide blades are independent of the airflow speed and/or the operating conditions of the extractor hood 1. Optimally the spacing between the individual air guidance elements 14 should be kept constant.

By means of the present invention a filtering of steam and other contaminants from the airflow through an extractor hood or a similar suction device is provided by means of removable portable electrostatic filter modules which are arranged in the suctioning region of the extractor hood 1.

An advantage of the present invention is that the electrostatic filter modules are arranged in the immediate suctioning region, in particular the suction slot of an extractor hood. Thus it is ensured that components of an extractor hood which are connected downstream, or arranged downstream, remain free from the collection of steam and other contaminants. In contrast to expanded metal fat filters, baffle filters and other fat filters available on the market, liquid and solid particles which are smaller than 1 μm are filtered out of the flow of steam. Even atomized oil fumes may be filtered by means of the filter units according to the invention. The odor filters, such as active carbon filters and zeolite filters, connected downstream for filtering odors are thereby protected from solid and liquid steam deposits and other contaminants, which increases the service life of the odor filters. A further advantage of the present invention is that the air filtering may also take place outside the cooking process in order to enhance the air quality of the internal spaces. Here the extractor hood is used so as to function as a room air cleaner outside the cooking process. Ideally, this function is carried out with very low volumetric flows of suctioned air. This function is particularly advantageous for allergy sufferers.

Further advantages of the invention, for example, are a very high filtering performance with low airflow speeds. In contrast to expanded metal fat filters, even with low volumetric flows and/or airflow speeds a very high filtering efficiency may be achieved by the electrostatic filter units according to the invention. In contrast to expanded metal filters, perforated metal filters, baffle filters, edge suction filters and other fat filter applications available on the market, the electrostatic filter units according to the invention have a low loss of pressure. Additionally, odors may be neutralized by ozone which is generated in the ionization unit by the ionization element. Finally, the removability and cleanability of the filter units is advantageous.

The invention claimed is:

1. A filter unit for an extractor hood, said filter unit comprising:

a housing configured to be releasably arranged in a suction slot of the extractor hood;

an electric contact element arranged on an exterior surface of the housing such that the electric contact element is accessible from an area outside of the housing, the electric contact element configured to electrically contact a voltage source arranged in the suction slot of the extractor hood when the housing is arranged in the suction slot;

an ionization unit accommodated in the housing; and a separation unit mounted in the housing downstream of the ionization unit in a direction of flow, wherein the housing includes a top wall, a bottom wall opposite the top wall, and at least three side walls connecting the top wall to the bottom wall, the top wall, the bottom wall, and the at least three side walls enclosing the ionization unit and the separation unit, and wherein one side of the side walls is arranged upstream of the ionization unit in the direction of flow and is at least partially formed by a protective grille via which air enters the housing in the direction of flow.

2. The filter unit of claim 1, wherein the housing is configured to have a drainage channel.

3. The filter unit of claim 1, wherein the separation unit includes an alternate arrangement of collection electrodes and counter electrodes, with the collection electrodes and counter electrodes representing plates which extend parallel to the bottom wall of the housing.

4. The filter unit of claim 1, wherein the separation unit includes an alternate arrangement of collection electrodes and counter electrodes, with the collection electrodes and counter electrodes representing plates which extend perpendicular to the bottom wall of the housing.

5. The filter unit of claim 4, wherein the collection electrodes are configured to form a comb profile and the counter electrodes are configured to form a comb profile, with the comb profile of the collection electrodes and the comb profile of the counter electrodes interlocking.

6. The filter unit of claim 1, wherein the ionization unit includes an ionization element which extends parallel to the bottom wall of the housing.

7. An extractor hood, comprising:

an extractor hood housing having:

a suction slot extends over at least a part of a periphery of the extractor hood housing, and a voltage source arranged within the suction slot; and a filter unit releasably arranged in the suction slot, the filter unit including:

a housing of the filter unit arranged in the suction slot and releasably connected to the extractor hood housing, an electric contact element arranged on an exterior surface of the housing of the filter unit, the electric contact element being electrically connected to the voltage source when the housing is arranged in the suction slot of the extractor hood, an ionization unit accommodated in the housing of the filter unit, and a separation unit mounted in the housing of the filter unit downstream of the ionization unit in a direction of flow, wherein the housing includes a top wall, a bottom wall opposite the top wall, and at least three side walls connecting the top wall to the bottom wall, the top wall, the bottom wall, and the at least three side walls enclosing the ionization unit and the separation unit, and wherein one side of the side walls is arranged upstream of the ionization unit in the direction of flow and is at least partially formed by a protective grille via which air enters the suction slot and the housing in the direction of flow.

8. The extractor hood of claim 7, wherein the housing of the filter unit is configured to have a drainage channel.

9. The extractor hood of claim 7, wherein the separation unit of the filter unit includes an alternate arrangement of collection electrodes and counter electrodes, with the collection electrodes and counter electrodes representing plates which extend parallel to the bottom wall of the housing of the filter unit.

10. The extractor hood of claim 7, wherein the separation unit of the filter unit includes an alternate arrangement of collection electrodes and counter electrodes, with the collection electrodes and counter electrodes representing plates which extend perpendicular to the bottom wall of the housing of the filter unit.

11. The extractor hood of claim 10, wherein the collection electrodes are configured to form a comb profile and the counter electrodes are configured to form a comb profile, with the comb profile of the collection electrodes and the comb profile of the counter electrodes interlocking.

12. The extractor hood of claim 7, wherein the ionization unit of the filter unit includes an ionization element which extends parallel to the bottom wall of the housing of the filter unit.

13. The extractor hood of claim 7, wherein the suction slot is oriented vertically with respect to a cooking surface disposed below the extractor hood.

14. The extractor hood of claim 7, further comprising a further said filter unit, wherein the filter unit and the further filter unit are arranged adjacent to one another in the suction slot.

15. The extractor hood of claim 7, further comprising an impact plate defining the suction slot downwardly, said filter unit being fastened to the impact plate.

16. The extractor hood of claim 7, further comprising a screen fastened to one of the filter unit and the extractor hood and arranged upstream of the protective grille.

17. The extractor hood of claim 16, wherein the screen is formed by a screen grille or by curved air guidance elements.

18. The filter unit of claim 1, wherein the exterior surface of the housing having the electric contact element is one of the top wall, the bottom wall, and another side of the at least three side walls.

19. The extractor hood of claim 7, wherein the one side of the side walls having the protective grille is configured to form an outward facing surface of at least a part of a length of the suction slot of the extractor hood.

20. The extractor hood of claim 14, wherein each of the filter unit and the further filter unit are individually releasably arranged adjacent to one another in the suction slot, wherein the further filter unit includes a further protective grille, and wherein the protective grille of the filter unit and the further protective grille of the further filter unit are configured to form an outward facing surface of at least the part of the length of the suction slot of the extractor hood.

* * * * *